US009296402B2

(12) United States Patent
Backes et al.

(10) Patent No.: US 9,296,402 B2
(45) Date of Patent: Mar. 29, 2016

(54) VEHICLE LOCATION IDENTIFICATION SYSTEMS AND METHODS

(71) Applicant: General Electric Company, Schenectady, NY (US)

(72) Inventors: Jess Backes, Melbourne, FL (US); Joseph Edward Tierney, Springfield, MO (US); Timothy Rolbiecki, Melbourne, FL (US); John Greg Zimmerman, Melbourne, FL (US)

(73) Assignee: General Electric Company, Schenectady, NY (US)

( * ) Notice: Subject to any disclaimer, the term of this patent is extended or adjusted under 35 U.S.C. 154(b) by 231 days.

(21) Appl. No.: 13/649,194

(22) Filed: Oct. 11, 2012

(65) Prior Publication Data

US 2013/0090801 A1 Apr. 11, 2013

Related U.S. Application Data

(60) Provisional application No. 61/545,802, filed on Oct. 11, 2011.

(51) Int. Cl.

| | |
|---|---|
| ***G05D 1/00*** | (2006.01) |
| ***B61L 23/10*** | (2006.01) |
| ***B61L 23/28*** | (2006.01) |
| ***B61L 25/02*** | (2006.01) |

(52) U.S. Cl.

CPC ..... *B61L 23/10* (2013.01); *B61L 23/28* (2013.01); *B61L 25/025* (2013.01)

(58) Field of Classification Search

CPC ..... B61L 25/023; B61L 25/025; B61L 23/10; B61L 23/28

USPC ..... 701/23, 445; 246/122

See application file for complete search history.

(56) References Cited

U.S. PATENT DOCUMENTS

| | | | | |
|---|---|---|---|---|
| 5,533,695 | A * | 7/1996 | Heggestad et al. | 246/62 |
| 5,740,547 | A * | 4/1998 | Kull et al. | 701/19 |
| 6,650,252 | B2 | 11/2003 | Miller | |
| 7,395,140 | B2 * | 7/2008 | Christie et al. | 701/19 |
| 7,729,819 | B2 * | 6/2010 | Rajaram | 701/19 |
| 8,170,732 | B2 * | 5/2012 | Daum et al. | 701/19 |

(Continued)

OTHER PUBLICATIONS

Wikipedia, Engineers' Line Reference (ELR), Wikipedia Online Encyclopedia, Sep. 2006.*

(Continued)

*Primary Examiner* — John Q Nguyen
*Assistant Examiner* — Nadeem Odeh
(74) *Attorney, Agent, or Firm* — GE Global Patent Operation

(57) ABSTRACT

A system includes an automatic control module, an automatic location module, and a manual location module. The automatic location module is configured to obtain, without operator intervention, first location information corresponding to a location of the vehicle. The manual location module is configured to obtain second location information via an operator input. The manually entered location information may include information corresponding to a first route on which the vehicle is disposed, where the first route is one of a plurality of routes located proximately to each other in a territory. The automatic control module is configured to control the vehicle to conform to a set of location-based regulations during a mission using location information including the first location information and the second location information.

12 Claims, 3 Drawing Sheets

(56) References Cited

U.S. PATENT DOCUMENTS

| | | | | |
|---|---|---|---|---|
| 2009/0105893 | A1* | 4/2009 | Kernwein | 701/19 |
| 2009/0198391 | A1* | 8/2009 | Kumar et al. | 701/2 |
| 2010/0063656 | A1 | 3/2010 | Knott et al. | |
| 2010/0312461 | A1* | 12/2010 | Haynie et al. | 701/117 |
| 2011/0051663 | A1 | 3/2011 | Cooper et al. | |

OTHER PUBLICATIONS

Wikipedia, Two Aspect Signal Photograph, Wikipedia Online Encyclopedia: Media File, Oct. 2004 (date of photograph).*

Railway Group Standard, GI/RT7033: Lineside Operational Safety Signs, Oct. 2009, Issue 2.*

Railway Group Standard, GK/RT0031: Lineside Signals and Indicators, Feb. 2002, Issue 4.*

Wikipedia Online Dictionary, Positive Train Control, Oct. 2010, Wikipedia.*

The Foursquare Blog, Location Verification, Apr. 2010, The Foursquare Blog (http://blog.foursquare.com/post/503822143/on-foursquare-cheating-and-claiming-mayorships).*

Australian Examination Report issued in connection with corresponding AU Application No. 2012238325 on Jul. 31, 2014.

* cited by examiner

VEHICLE LOCATION IDENTIFICATION SYSTEMS AND METHODS

RELATED APPLICATIONS

This application claims priority to U.S. Provisional Patent Application Ser. No. 61/545,802, filed 11 Oct. 2011 (the '802 Application). The '802 Application is incorporated herein by reference in its entirety.

FIELD

Embodiments of the subject matter described herein relate to vehicle location systems and methods, and more particularly, to systems and methods for determining position of a vehicle disposed on one of a plurality of proximately located routes.

BACKGROUND

Vehicle control systems may be used with transportation networks to prevent more than one vehicle from traversing a given route at the same time to help avoid accidents. Further, such control systems may be used to prevent damage to switches or other track components, for example, by preventing a vehicle from traversing over a switch when the switch is not in the proper alignment relative to the vehicle's path. Such control systems may be disposed on-board a vehicle, and configured to stop the vehicle or otherwise prevent the vehicle from traversing an intended path when another vehicle is determined to be on the route, or when a switch or other component is not in a correct alignment. For example, if a train enters a mainline track from a siding when the switch leading to the mainline is not properly aligned, the train may damage the switch, resulting in required time and expense for repair and/or replacement. Further, the entry of a train onto the mainline may result in a collision with another train on the mainline if the position of one or more of the trains is not known.

A control system may include interlocked routes that may form one dimensional rail paths to represent one or more transportation networks. In other words, a train's path may be described as a series of mile posts or other interval markers between a starting and an end point. The path may also include control points such as switches, sidings, stations, or the like where the train may traverse alternate route segments, or switch from one track or route to another. Control systems, such as the Incremental Train Control System ("ITCS") of GE Transportation, may include a communication-based signal system that identifies vehicle location using global positioning system (GPS) data received onboard a vehicle, such as a train. The control system may need to determine the vehicle's position to enforce speed limits or other regulations or targets as the vehicle traverses the route.

However, the accuracy of GPS data may not be sufficient to identify a particular route or track that the vehicle is on if there are multiple (e.g., parallel) tracks in the area. Thus, a vehicle may have to move to an area where there is only a single track or route before the position of the vehicle may be determined. Thus, the control system may not be allowed to be used until the vehicle is in a single track area, increasing the risk of accident and/or preventing the vehicle from benefiting from the control system.

A need exists for improved determination of location for vehicles in areas having multiple routes or tracks.

BRIEF DESCRIPTION

In one embodiment, a system includes an automatic control module, an automatic location module, and a manual location module. As used herein, the terms "system" and "module" include a hardware and/or software system that operates to perform one or more functions. For example, a module or system may include a computer processor, controller, or other logic-based device that performs operations based on instructions stored on a tangible and non-transitory computer readable storage medium, such as a computer memory. Alternatively, a module or system may include a hard-wired device that performs operations based on hard-wired logic of the device. The modules shown in the attached figures may represent the hardware that operates based on software or hard-wired instructions, the software that directs hardware to perform the operations, or a combination thereof.

The automatic control module is configured to be disposed onboard a vehicle, and to control the vehicle to conform to a set of location-based regulations along a route during a mission using location information. The location information may include first location information and second location information. The automatic location module may be configured to automatically obtain, without operator intervention, the first location information. The manual location module may be configured to obtain the second location information via an operator input. The second location information may include information corresponding to a first route on which the vehicle is disposed, where the first route is one of a plurality of routes located proximately to each other in a territory. Each of the plurality of routes may be configured for traversal by the vehicle.

In another embodiment, a method includes obtaining, at a processing unit (e.g., a processing unit disposed onboard a vehicle), manually entered location information including information corresponding to a first route on which the vehicle is disposed. The first route is one of a plurality of routes located proximately to each other in a territory, with each of the plurality of routes configured for traversal by the vehicle. The method also includes obtaining, at the processing unit, automatically obtained location information from an automatic location detection module. The method also includes determining a determined position of the vehicle using the manually entered location information and the automatically obtained location information. The determined position of the vehicle includes an identification of a particular route on which the vehicle is disposed and information corresponding to a location along the particular route. The method further includes controlling the vehicle using an automatic control system based upon the determined position of the vehicle, wherein controlling the vehicle comprises conforming with a set of location-based regulations using the determined position of the vehicle.

In another embodiment, a tangible and non-transitory computer readable medium includes one or more computer software modules configured to obtain manually entered location information including information corresponding to a first route on which a vehicle is disposed, wherein the first route is one of a plurality of routes located proximately to each other in a territory, wherein each of the plurality of routes is configured for traversal by the vehicle. The computer readable medium is further configured to direct the processor to obtain automatically obtained location information from an automatic location detection module. The computer readable medium is further configured to direct the processor to control the vehicle, using an automatic control system, based upon the determined position of the vehicle to conform with a set of location-based regulations using the determined position of the vehicle.

BRIEF DESCRIPTION OF THE DRAWINGS

The present inventive subject matter will be better understood from reading the following description of non-limiting embodiments, with reference to the attached drawings, wherein below.

DETAILED DESCRIPTION

Figure 1:
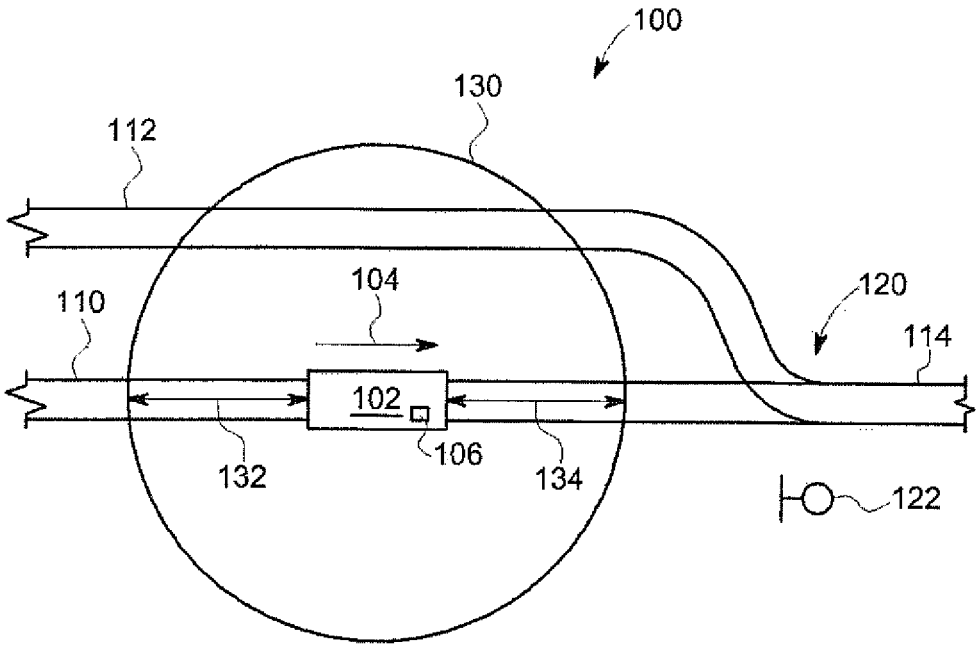
FIG. 1 is an overhead view of a transportation network.

One or more embodiments of the inventive subject matter described herein provide systems and methods for improved determination of a position of a vehicle in a transportation network or system for use with a control system, such as ITCS. For example, embodiments provide for the use of manually input information to determine a starting position and automatically input information to confirm the manually input information and/or to update the location of the vehicle during performance of a mission. Embodiments provide for the manually input information to specify which route the vehicle is disposed on out of a plurality of generally parallel routes. Embodiments also provide for cost-effective and low-maintenance identification of position of a vehicle.

A technical effect of embodiments includes more accurate and/or less time consuming determination of a vehicle's position for use with a control system, such as ITCS. A technical effect of embodiments includes improvement in safety, for example, by helping prevent collisions caused by lack of accurate knowledge of a vehicle's position. An additional technical effect of embodiments includes reduction of the time and expense for maintenance and/or repair costs for damaged switches and/or other components caused by lack of accurate knowledge of a vehicle's position. An additional technical effect of embodiments includes improved efficiency of a transportation network by reducing unnecessary lockouts.

Throughout this document, the term vehicle consist is used. A vehicle consist is a group of two or more vehicles that are mechanically coupled to travel together along a route. A vehicle consist may have one or more propulsion-generating units (e.g., vehicles capable of generating propulsive force, which also are referred to as propulsion units) in succession and connected together so as to provide motoring and/or braking capability for the vehicle consist. The propulsion units may be connected together with no other vehicles or cars between the propulsion units. One example of a vehicle consist is a locomotive consist that includes locomotives as the propulsion units. Other vehicles may be used instead of or in addition to locomotives to form the vehicle consist. A vehicle consist can also include non-propulsion generating units, such as where two or more propulsion units are connected with each other by a non-propulsion unit, such as a rail car, passenger car, or other vehicle that cannot generate propulsive force to propel the vehicle consist. A larger vehicle consist, such as a train, can have sub-consists. Specifically, there can be a lead consist (of propulsion units), and one or more remote consists (of propulsion units), such as midway in a line of cars and another remote consist at the end of the train. The vehicle consist may have a lead propulsion unit and a trail or remote propulsion unit. The terms "lead," "trail," and "remote" are used to indicate which of the propulsion units control operations of other propulsion units, and which propulsion units are controlled by other propulsion units, regardless of locations within the vehicle consist. For example, a lead propulsion unit can control the operations of the trail or remote propulsion units, even though the lead propulsion unit may or may not be disposed at a front or leading end of the vehicle consist along a direction of travel. A vehicle consist can be configured for distributed power operation, wherein throttle and braking commands are relayed from the lead propulsion unit to the remote propulsion units by a radio link or physical cable. Toward this end, the term vehicle consist should be not be considered a limiting factor when discussing multiple propulsion units within the same vehicle consist.

FIG. 1 provides an overhead view of a transportation network 100 being traversed by a vehicle 102 in a direction 104. The transportation network 100 in the illustrated embodiment includes routes (e.g., railroad tracks) configured to be traversed by a train. For example, the vehicle 102 may include a rail vehicle consist that includes a control system, such as ITCS, associated therewith. The vehicle 102 may include a location detector 106. In various embodiments, the vehicle 102 may be controlled by an onboard operator, the vehicle 102 may by controlled by an off-board operator, and/or the vehicle 102 may operate autonomously.

The transportation network includes a first route segment 110, a second route segment 112, a third route segment 114, a switch 120, and a signal 122. The second route segment 112 extends generally parallel to the first route segment 110 until the second route segment 112 curves to join the first route segment 110 proximate to the switch 120 to enter the third route segment 114. For a vehicle (e.g., vehicle 102) to enter the third route segment 114 from either of the first route segment 110 or the second route segment 112, the switch 120 may be aligned with the appropriate track. The signal 122 is configured to provide a visual indication (e.g., a red light for stop, a green light for go) indicating to the vehicle 102 if the switch is aligned for the entry of vehicle 102 or not.

The vehicle 102 is configured to use the location detector 106 to determine the location of the vehicle, with the location of the vehicle used by a control system (e.g., ITCS) to prevent the vehicle 102 from traversing a route segment occupied by another vehicle (e.g., locking out the particular segment of track to the vehicle 102), to prevent the vehicle 102 from traversing a misaligned switch, and the like. The location detector 106, however, has a margin of error in ability to determine the precise location of the vehicle 102. In the illustrated embodiment, the location detector 106 has an uncertainty window 130 depicted by a circle, which represents a range of possible actual positions of the vehicle 102 (or a portion thereof) due to the margin of error of the location detector 106.

In terms of the position of the vehicle 102 along a given route or track segment, a buffer may be added on either side of the vehicle 102 along the direction of travel 104 to address the uncertainty. In the illustrated embodiment, a forward (in the direction of travel) buffer 134 is provided to compensate for a "Worst Case Ahead" ("WCA") scenario, and a rearward (in the direction of travel) buffer 132 is also provided to compensate for a "Worst Case Behind" ("WCB") scenario. Thus, in controlling the vehicle 102, the control system (e.g., ITCS) may "see" the vehicle as extending from the outside edge of the rearward buffer 132 to the outside edge of the forward buffer 134 for the purposes of determining the location of the vehicle 102 along a given track.

However, as seen in FIG. 1, the uncertainty window 130 of the location detector 106 also includes the second route segment 112. Thus, the route on which the vehicle 102 is disposed may not be determined by use of the location detector 106 alone. For example, the information provided by the location detector 106 is insufficient to determine whether the vehicle 102 is on the first route segment 110 or on the second route segment 112. In other embodiments, for example, additional generally parallel tracks may also be present, with the location detector 106 unable to provide sufficient certainty regarding which of the plurality of generally parallel tracks the vehicle 102 is disposed upon.

The resulting uncertainty prevents a control system, such as ITCS, from being able to determine which route segment the vehicle 102 is on. For example, for the transportation network 100 depicted in FIG. 1, the control system cannot differentiate between the first route segment 110 and the second route segment 112 in terms of which track the vehicle 102 is disposed upon. Thus, the control system cannot properly determine if the switch 120 is aligned appropriately for the planned travel of the vehicle 102. Further, the control system (as well as any external system accessible by a plurality of additional vehicles) is unable to determine if any other vehicles are on a same route segment or portion as the vehicle 102, thereby increasing the risk of collision. The control system may be disabled and/or otherwise unused or ineffective until the position of the vehicle 102, including the specific track out of a plurality of proximately positioned tracks, may be determined. For example, the control system may not be employed until the vehicle 102 enters a single track area (e.g. an area where there are no generally parallel tracks proximately positioned to a track the vehicle 102 traverses). If the vehicle 102 never enters such a single track area during performance of a mission, or if the vehicle 102 does not enter such an area for a substantial distance, then an initial, starting, or reference position may not be determined and the control system may not be employed or may be substantially restricted in utility.

Further still, for routes which may be traversed in either direction along the route, the information from the location detector 106 may not be sufficient to satisfactorily determine the direction of the vehicle 106. For instance, to determine a direction of travel for the vehicle 102, a series of GPS readings may be taken, with more recent readings compared to earlier reasons to determine a difference between the readings, which may be used to determine the direction of travel (e.g., if later readings are to the west of earlier readings, the vehicle 102 may be determined as traveling in a westward direction). However, due to the window of uncertainty 130, the vehicle 102 may be required to travel a substantial distance before the direction of travel may be determined.

Figure 2:
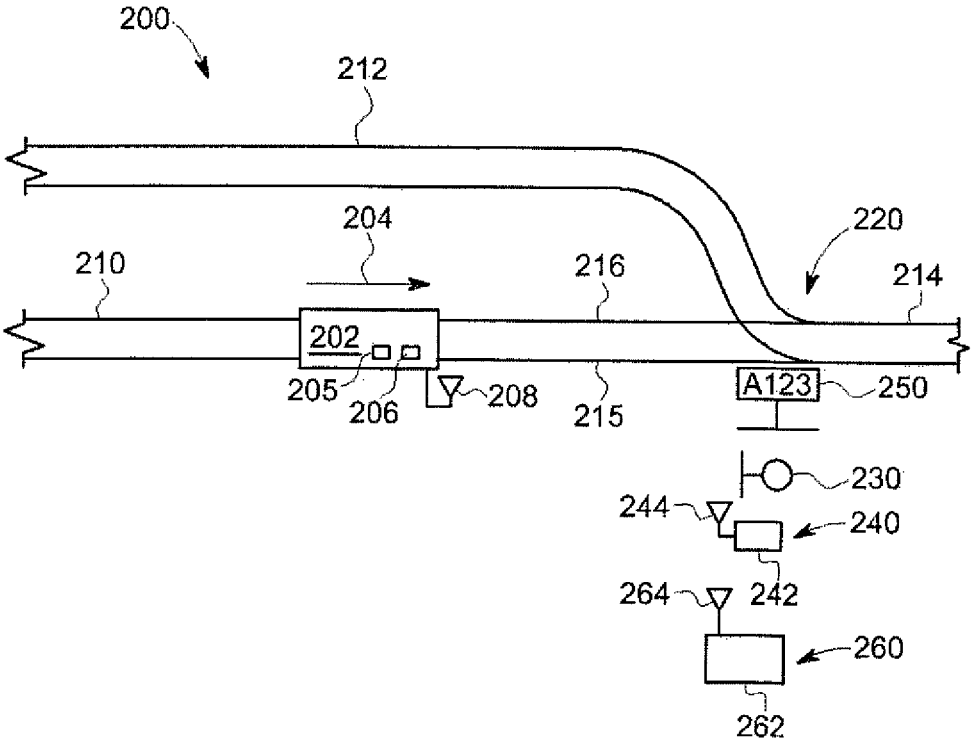
FIG. 2 is an overhead schematic diagram of a transportation network in accordance with one embodiment.

FIG. 2 provides an overhead schematic diagram of one embodiment of a transportation network 200 formed in accordance with one embodiment. The transportation network 200 includes a vehicle 202 traversing the network in a direction 204. The vehicle 202 may include a rail vehicle consist or another vehicle capable of self-propulsion. The transportation network 200 in the illustrated embodiment includes routes (e.g., tracks) configured to be traversed by a rail vehicle consist or train. For example, the vehicle 202 may be a rail vehicle consist including powered units (e.g. locomotives or other systems capable of self-propulsion) and non-powered units (e.g., railcars or other systems incapable of self-propulsion, but which may otherwise consume power to perform one or more operations).

The vehicle 202 includes an on-board computer 205, an automatic location detector 206, and an antenna 208. The on-board computer 205 is configured to perform automatic control of the vehicle 202 in conjunction with a control system, such as ITCS.

Generally speaking, the on-board computer 205 is configured to track the location of the vehicle 202 as the vehicle traverses a particular route or track, and to perform appropriate automatic control operations (e.g., stop the vehicle 202 at a switch until the switch is properly aligned, stop the vehicle 202 from entering a segment of track occupied by a different vehicle, and the like). (A more detailed discussion of modules or other aspects that may form a portion of the on-board computer in some embodiments is found below, as well as in connection with the discussion of FIG. 3.) The on-board computer 205 is also configured to receive manually input location information (e.g., from an operator entering location information via a keyboard or touchscreen) and automatically input location information from the automatic location detector 206. The on-board computer 205 may be configured to operate pursuant to an ITCS scheme or system using the manually input location information and the automatically input location information. For example, the on-board computer 205 may determine an initial position (including the particular track or route on which the vehicle 202 is disposed) of the vehicle 202 using the manually input location information, and may use the automatically input location information to track the vehicle 202 as the vehicle 202 traverses the network 200. In some embodiments, the manually input information includes information specifying a particular route on which the vehicle 202 is disposed. The particular route may be one of a plurality of generally parallel routes located proximately to each other in a territory. In some embodiments, the on-board computer 205 may use information from the automatic location detector 206 to confirm or check information input manually.

The automatic location detector 206 is configured to provide information regarding the location of the vehicle 202 automatically (e.g., without human intervention or manual entry of information). The on-board computer 205 is configured to receive automatic location information from the automatic location detector 206 and to use the automatic location information to determine one or more aspects of an initial starting position of the vehicle 202 determined by the on-board computer 205 in conjunction with manually input location information, confirm one or more aspects of manually input location information, and/or update a current location of the vehicle 202 as the vehicle 202 traverses a route. In some embodiments, one or more different types of automatic location detectors may be employed. For example, in the illustrated embodiment, the automatic location detector may include a Global Positioning System (GPS) detector. Alternatively or additionally, automatic location detectors may include axle tachometers or other distance measuring equipment; off-board transponders and/or receivers configured to receive information from off-board equipment (e.g. a receiver configured to receive information from a switch the vehicle 202 passes over identifying a route or track entered by the vehicle as a result of passing over the switch); inertial detectors; detectors associated with, for example, LORAN or GLONASS systems; a processor, unit, or module that determines the location of the vehicle 102 based on the speed of the vehicle 102 and a time elapsed since the vehicle 102 was at a designated location; a processor, unit, or module that determines the location of the vehicle 102 using triangulation of wireless network signals; or the like.

The antenna 208 is configured to communicate information with one or more aspects of the transportation network 200 disposed off-board of the vehicle 202. In some embodiments, the vehicle 202 may include a plurality of antennas 208 for communicating with a corresponding plurality of off-board locations or types of off-board locations. Further, the vehicle 208 may include one or more antennas for communication with other portions of the vehicle. For example, in embodiments where the vehicle 202 includes a rail vehicle consist, various units of the consist may communicate with each other via antennas. The antenna 208, for example, may communicate regarding location and/or control (e.g., messages for use by an ITCS system) of the vehicle 202 with the wayside station 240 and/or the central scheduling station 260.

The transportation network includes a first route segment 210, a second route segment 212, a third route segment 214, a switch 220 and a signal 230. The second route segment 212 extends generally parallel to the first route segment 210 until the second route segment 212 curves to join the first route segment 210 proximate to a switch 220 to enter the third route segment 214. For a vehicle (e.g., vehicle 202) to enter the third route segment 214 from either of the first route segment 210 or the second route segment 212, the switch 220 may be aligned with the appropriate track. The signal 230 is configured to provide a visual or other indication indicating to the vehicle 202 if the switch 220 is aligned for the entry of vehicle 202 or not.

The transportation network 200 also includes a wayside station 240, a central scheduling station 260, and a position identification sign 250. The wayside station 240 may be one of a plurality of substantially similar wayside stations. In the illustrated embodiment, the wayside station 240 is shown positioned proximate to the signal 230. Additionally or alternatively, in some embodiments, wayside stations 240 may be positioned in locations not proximate to signals.

The central scheduling station 260 may include a scheduling module 262 and an antenna 264. The scheduling module 262 may be configured to determine and provide a schedule to the vehicle 202 via the antenna 208 of the vehicle. The antenna 264 (or an additional antenna) may be used to communicatively couple the central scheduling station 260 with the wayside station 240. The central scheduling station 260 may include fixed data files stored in a central computer (e.g., scheduling module 262 or a computer associated therewith) which contain all data relating to the profile of a route under control. The fixed data may be considered as including a library of information that may remain unchanged for the route under normal conditions. The fixed data may include timetable speed limits, civil speed restrictions, the location of route under repair and an appropriate temporary slow order, the location of critical locations or any other points at which a control action may be required, and the like. A communicative link (e.g., a link between the antennas 264, 244 or a wired connection) may join the central scheduling station 260 with the wayside station 240.

The wayside station 240 may include a wayside control module 242 and an antenna 244. The antenna 244 may be configured to communicate with the central scheduling station 260 via antenna 264 and/or the vehicle 202 via the antenna 208. The wayside station 240 may include a computer (e.g., wayside control module 242) that includes logic and/or data associated with the particular location of the wayside station 240 in the transportation network 200. A series of wayside stations 240 may be spaced along the track of the transportation network 200 being controlled at interlockings and special detection sites. Appropriate portions of the fixed data files of the central scheduling station 260 may be downloaded to the wayside stations 240 so that each particular wayside station 240 has the profile of the local area of the transportation network under the control of that particular wayside station 240.

The on-board computer 205 of the vehicle 202 may receive profile and authority messages via the antenna 208 from the central scheduling station 260 and/or one or more wayside stations 240. The on-board computer 205 may, for example, monitor and enforce speed limits using information received from the central scheduling station 260 and/or one or more wayside stations 240. The on-board computer 205 may slow or stop the vehicle 202 using information received from the central scheduling station 260 and/or one or more wayside stations 240 (e.g., information regarding interlocked segments of track which have one or more other vehicles disposed thereon, information regarding switches that are not aligned for traversal by the vehicle 202, and the like).

The on-board computer 205 in the illustrated embodiment is configured to control operation of the vehicle 202, for example, by applying the brakes directly to meet a braking target (e.g., a braking target to stop or slow the vehicle 202 based on occupancy of a segment of track or based on an upcoming misaligned switch), to instruct an operator to perform a braking activity to meet the braking target, or a combination thereof. The on-board computer 205 may be configured to over-ride a previously configured trip plan to perform one or more braking activities. The on-board computer 205, for example, may use messages received from the wayside station 240 and/or the central scheduling system 260 regarding conditions of an upcoming portion of a route to be traversed by the vehicle 202, and use information from those messages in conjunction with a position of the vehicle 202 determined by the on-board computer 205 to control operation of the vehicle 202.

The position identification sign 250 provides an example of a visual cue an operator may utilize to manually enter location information into the on-board computer 205. In the illustrated embodiment, the position identification sign 250 includes a printed alpha-numeric message represented by "A123" in FIG. 2. In other embodiments, other arrangements may be employed to convey location or position information via the position identification sign 250. An operator of the vehicle 202 may view the alphanumeric code displayed on the position identification sign 250, and enter all or portions of the information from the position identification sign 250 into the on-board computer, which in turn uses the information to determine a position of the vehicle 202. A plurality of position identification signs 250 may be disposed along the various tracks or routes of the transportation network 200 at locations of interest or control points, such as proximate to signals 230 and/or wayside stations 240 and/or switches 220. As the position identification signs 250 will be easier for an operator to read when the vehicle 202 is at a stop, the position identification signs 250 may be positioned in areas where the vehicle will be stopped, for example proximate to signals 250. Further, the position identification signs 250 may be disposed alongside a predetermined side of the track or route. In the illustrated embodiment, the track or route being traversed by the vehicle 202 includes a first side 215 and a second side 216, with the position identification sign disposed toward the first side 215. For example, in a network where the operator of the vehicle 202 will have better visibility toward a given side in the direction of travel, the position identification signs 250 may be disposed toward that particular side of the track or route.

The information conveyed by the position identification sign 250 may include several types of information. One portion of an alpha-numeric code may convey information corresponding to a particular track or route that the vehicle 202 is disposed upon. For example, in areas where there are multiple tracks or routes, each particular route may be assigned a particular identifying letter, number, name, or other indicator (e.g., individual tracks "1", "2", and "3" in a location having 3 proximately located generally parallel tracks; individual tracks "A", "B", "C", and "D" in a location having four proximately located generally parallel tracks).

In some embodiments, a portion of the alpha-numeric code may convey information corresponding to a direction that the vehicle 202 is traversing or is oriented to traverse. For example, the position identification sign 250 may include a letter, number, or combination of a letter and number identifying the direction in which the operator is looking at the position identification sign 250 (e.g., the letter, number, or combination may correspond to an entry in a database specifying a corresponding direction). In embodiments where the operator may be facing in a direction other than the direction of travel (e.g., the vehicle 202 oriented in a dead-end siding with the operator facing the dead-end), the operator may be given an option during entry of manually input location information to specify if the train is heading in the same or opposite direction as the operator is facing (or the same or opposite direction of the sign from which information is being entered). In various embodiments, each particular sign may only be visible when the vehicle 202 is oriented in a particular direction, so that the identification of the sign's position or an associated signal may be sufficient to specify the direction of travel as well.

In some embodiments, a portion of the alpha-numeric code may convey information corresponding to a location along a particular track or route that the vehicle 202 is disposed upon. For example, the on-board computer 205 may include or have access to a database identifying each signal 230 in the transportation network 200 or a portion of the transportation network 200. Each position identification sign 250 may be positioned proximate to and associated with a corresponding signal 230, with the alpha-numeric code displayed on the position identification sign 250 identifying or corresponding to the particular signal 230 associated therewith. The position identification sign 250 may thus be correlated with the signal 230 in the database, and may be used to determine the location of the vehicle 202 along the particular track or route.

The position identification signs, for example, may be disposed on the right side of a track (in the direction of travel) proximate to a corresponding signal, and the signal name or identifier may be used with the sign as well. The position identification signs 250 may be cyclone rated. Further the position identification signs 250 may be lit and/or reflective to improve nighttime visibility and readability. Appropriate maintenance procedures may be developed and adhered to maintain the position identification signs 250 in a generally clean and easily readable state. In some embodiments, the position identification sign 250 may include a displayed code in the format of "A"-"B"-"C", where A is an alphanumeric code of one or more characters corresponding to the particular track on which the vehicle is disposed, B is an alphanumeric code of one or more characters corresponding to the orientation or direction of the vehicle, and C is an alphanumeric code of one or more characters corresponding to the location of the vehicle along the track on which the vehicle is disposed (e.g., a mile post or other indicator of location along the track).

The above discussion is meant as illustrative in nature, as other combinations or arrangements of location identification for manual input may be employed in other embodiments. In some embodiments, entry of all or a portion of the manually input information obtained from an operator's viewing of a position identification sign may be responsive to prompts provided via an input device of the on-board computer 205. For example, with the vehicle at a stop, an operator may enter information from the position identification sign that identifies the position of the sign along a track and/or a corresponding signal proximately located. If the track is in a two-track area, the on-board computer 205 may provide a prompt requesting the operator to input whether the train is on the right track or the left track in the direction of travel, or other identification of a particular track based upon an observation of the operator instead of or in addition to information on a particular sign. Similarly, if the track is in an area with more than two generally parallel tracks, the prompt may request the operator to identify how many tracks are to a given side of the vehicle 202. Thus, embodiments provide for the use of visual cues to an operator for entry into an on-board computer for location or position identification of a vehicle in a multi-track or multi-route area. Such visual cues may be positioned to provide for convenient and quick entry of location information at points where a vehicle is likely to be stopped, such as at a signal. Further, such visual cues, provided, for example, via a position identification sign, result in reduced cost and maintenance compared to certain automated location identification methods.

An example of determination of the position of the vehicle 202 will now be discussed in accordance with an embodiment, with reference to the above discussion and FIG. 2. With the vehicle 202 at a stop with a position identification sign 250 visible to the operator, the operator reads the information from the sign and inputs the information to the on-board computer 205 using, for example, a touch screen, or, as another example, a keyboard. The on-board computer 205 may include a display that provides prompts for the manual entry of information. For example, the on-board computer 205 may display a screen configured for the manual location entry when the vehicle 202 is stopped at a signal 230 and the on-board computer 205 has not already determined the location of the vehicle 202, including the particular route or track on which the vehicle 202 is disposed.

After the information is input, the on-board computer 205 may access a database including location information corresponding to the input information and/or obtain a location reading from a GPS detector. In some embodiments, the on-board computer 205 uses information manually input (e.g., a particular track and/or a direction of travel) in conjunction with information obtained from a database (e.g., location along the length of the particular track or route corresponding to the particular sign) to determine the location of the vehicle 202. An offset may be employed to account for the difference in position from the sign to the front of the vehicle 202 (and/or rear of the vehicle 202). For example, in embodiments where the operator is consistently positioned in a foremost unit of the vehicle 202, a set off-set accounting for the position of the operator relative to the front of the vehicle 202 and the sign may be employed. In embodiments where the operator may be located in different units of a consist (e.g., in the foremost unit of the consist on one trip, and in a different unit of the consist on a different trip or at a different time) the offset employed may be variable and determined based upon the position of the operator within the consist at the time of the entry of information. Further still, the length of the consist may be used to determine the location or position of the consist, for example in connection with determining a Worst Case Ahead (WCA) and/or a Worst Case Behind (WCB). Additionally, information from an automatic location detector, such as a GPS detector may be used in conjunction with manually input information (e.g., a particular track and direction utilized from the manually input information and a location along the particular track from the automatically input information).

Further still, in some embodiments, the on-board computer 205 confirms or performs a check on the manually input information using automatically input information. For example, if the manually input information regarding location along the particular route or track is substantially different from the automatically input information, the on-board computer 205 may provide a prompt to the operator to re-enter the information. As another example, as the vehicle 202 progresses along a trip, a change or trend in the automatic location information may be monitored to check the direction of travel of vehicle 202.

With the initial position thus known, once the vehicle 202 initiates movement, the current position of the vehicle may be determined by using a previous position and updating based on additionally received information as the trip progresses. For example, as the vehicle 202 progresses along the track, information from a GPS detector or other automatic location detector may be employed. As another example, information received from a wayside station and/or signal passed may be used to update a location determination. The identification of the particular track or route may be updated as well. For example, if the vehicle 202 passes over a switch to change to a different track, information transmitted from the switch or a wayside station associated with the switch may be used to update the identified track on the on-board computer 205.

Thus, in various embodiments, manually entered and automatically entered location information is used to determine the position of a vehicle (e.g., identification of a particular track upon which the vehicle is disposed, direction of orientation of the vehicle, and position along the particular track upon which the vehicle is disposed). Embodiments provide for the quick and convenient determination (e.g., by an on-board computer) of a position of a vehicle (including the particular track or route upon which the vehicle is disposed) disposed within a multi-track area, which allows for improved control by automatic control systems, which otherwise may have to wait until the vehicle entered a single track area to properly function.

Figure 3:
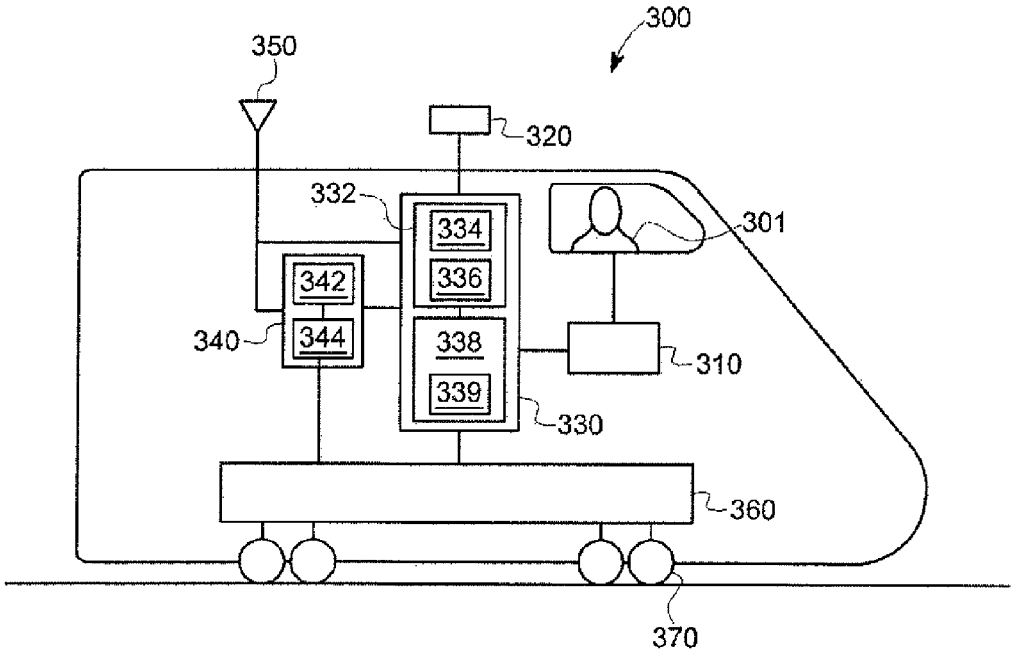
FIG. 3 is a schematic view of a vehicle system in accordance with one embodiment.

FIG. 3 provides a schematic view of a vehicle system 300 formed in accordance with an embodiment. The vehicle system 300 may include, for example, a rail vehicle consist including rail vehicle units (e.g., locomotives and non-powered units). The vehicle system 300 of the illustrated embodiment includes a manual input module 310, an automatic location module 320, an automatic control module 330, a trip planning control module 340, an antenna 350, a propulsion system 360, and wheels 370. Generally speaking, in the depicted embodiment, the trip planning control module 340 is configured to plan a trip and to provide control messages, either to an operator and/or directly to the propulsion system 360, to propel the vehicle system 300 along a trip or mission. The propulsion system 360 may include one or more motors and one or more brakes, with the control messages configured to cause the propulsion system to engage in braking or motoring activities in accordance with a trip plan. The automatic control system 330 is configured in the illustrated embodiment to override the trip planning control module 340 and/or an operator control, for example, to stop or slow the vehicle system 300 in accordance with a rule, for example a speed limit, or a safety condition, for example, a lockout or circumstance where another vehicle occupies a segment of a route the vehicle system 300 would otherwise enter pursuant to a command by the trip planning control module 340 and/or operator control. The automatic control module 330 utilizes information from the manual input module 310 and the automatic input module 320 to determine the position of the vehicle system 300 (including a particular route upon which the vehicle system is disposed), and uses information received from an external source or sources (e.g., wayside stations, central scheduling stations) and/or information stored on a database included as a part of or accessible to the automatic control module 330 to determine any rules or conditions that require intervention by the automatic control module 330 based on the position or location of the vehicle system 300. The antenna 350 is configured for communication between the vehicle system 300 and one or more off-board systems, such as, for example, wayside stations and/or central scheduling systems and/or other vehicles traversing a transportation network. The rail vehicle system 300 is depicted as a single powered rail vehicle unit for ease of depiction. Other vehicle systems, including rail vehicle consists, may be employed in other embodiments.

The manual input module 310 is configured to obtain manually input information including manually input location information. The manually input information may be entered, for example, by an operator 301 using one or more of a keypad, touchscreen, keyboard, mouse, stylus, or the like. In some embodiments, the automatic control module 330 (e.g., a manual location module 334 of the automatic control module 330) may provide prompts as part of a form to be filled in by an operator 301, or, as another example, via a series of prompts. The prompts may be responsive to a previous entry by an operator 301. For example, after an operator 301 enters information corresponding to an identification of a position identification sign (e.g., position identification sign 250), the operator 301 may be prompted to enter a direction of travel via the manual input module 310.

The manually input information may correspond to information obtained via operator observation from one or more sources. For example, as also discussed above, the manually input information may be obtained from a sign or other object configured to convey position information and mounted, hung, or otherwise disposed proximate to a track or route. The manually input information may also correspond to a feature or characteristic of a track or route. For example, the manually input information may identify a route by position relative to other proximate tracks (e.g., the right-most route of four generally parallel routes, the center route of three generally parallel routes, and the like).

The automatic input module 320 is configured to automatically obtain location information (e.g., without operator intervention). The automatically obtained information may correspond to a particular route or track (e.g., automatically obtained information may describe a change in particular track being traversed due to the activation of a switch); a location along a track or route (e.g., information from a GPS detector giving a geographic position or identifying a segment of a track or route where the vehicle system 300 is located); and/or a direction (e.g. information from a GPS detector taken at different times with the vehicle system 300 in motion used to determine a trend or direction). In the illustrated embodiment, one automatic input module 320 is depicted, however, in some embodiments, a plurality of automatic input modules 320 may be employed. For example, the vehicle system 300 may include one or more of a GPS detector, an axle tachometer, inertial system, LORAN system, or the like. Further, the automatic input module may include a receiver configured to receive location information from a transponder associated with a track or route on which the vehicle system 300 is disposed, for example a transponder associated with a wayside station, a switch, and/or a signal. For example, a message associated with a switch may provide information regarding a change from one track or route to another due to a position of the switch, or a message from a wayside station may include information corresponding to a vehicle's position along a route or track based on the location of the wayside station.

The automatic input module 320 is configured to automatically obtain location information used to supplement, confirm, or update manually input location or position information. For example, information identifying a particular track upon which the vehicle system 300 is disposed as well as a direction of travel may be manually entered by an operator via the manual input module 310. Information from the automatic location module may be used to provide a location along the particular track. Additionally or alternatively, information from the automatic input module 320 may be used to check or confirm information manually entered. For example, if location from a GPS detector differs substantially from a location determined based upon manual entry, an operator may be prompted to re-enter the manually input information, or, as another example, the automatic control system may be disabled until the location information can be confirmed. Once the position is successfully entered, and the vehicle 300 is no longer stationary, information from one or more automatic input modules 320 may be used to update the location of the vehicle 300 along the particular route as well as to update any change in route upon which the vehicle 300 is disposed. For example, a message from a signal or a component therewith may provide information used to update the route when the vehicle 300 passes over a switch.

In the illustrated embodiment, the automatic control module 330 is configured to control the vehicle system 300 to conform to a set of regulations along a route during a trip or mission performed by the vehicle system 300. The regulations may be location-based regulations. The regulations may be based on a rule or requirement of operation for a particular route segment, such as a speed limit or the like. The regulations may also correspond to a condition of a track or related componentry, such as if a route segment is occupied by a different vehicle, if a switch is misaligned, or the like. The automatic control module 330 may use location information provided by the manual input module 310 and the automatic input module 320 to determine appropriate automatic control activities. The automatic control module 330, when enabled, may override or interrupt a previously planned controlled activity (e.g., a control activity previously determined by the trip planning control module 340) and/or an operator controlled activity.

For example, if the automatic control module determines that the vehicle system 300 is on course to traverse over a mis-aligned switch, the automatic control module 330 may control the propulsion system 360 to perform a braking activity to stop the vehicle system 300 before traversing the misaligned switch. As another example, if the automatic control module 330 determines that the vehicle system 300 is about to enter a route segment occupied by a different vehicle, the automatic control module 330 may control the propulsion system 360 to perform a braking activity to stop or slow the vehicle system 300, allowing the other vehicle to leave the route segment about to be entered by the vehicle system 300. In some embodiments, the automatic control module 330 may provide a warning indication to an operator of the vehicle system 300 indicating a potential upcoming automatic control activity. Embodiments provide for the use of manually input location information (e.g., identifying a particular route on which a vehicle is disposed from among a plurality of generally parallel routes) allowing the automatic control module 330 to more quickly determine the position of the vehicle system 300, thereby allowing an automatic control system to engage at an earlier time than is possible with certain known systems.

The automatic control module 330 includes a location module 332 and a memory 338. The location module 332 includes a manual location module 334 and an automatic location module 336. The memory 338 includes a database 339.

The automatic control module 330 and/or the location module 332 includes a controller, such as a computer processor or other logic-based device that performs operations based on one or more sets of instructions (e.g., software). The instructions on which the controller operates may be stored on a tangible and non-transitory (e.g., not a transient signal) computer readable storage medium, such as the memory 338. The memory 338 may include one or more computer hard drives, flash drives, RAM, ROM, EEPROM, and the like. Alternatively, one or more of the sets of instructions that direct operations of the controller may be hard-wired into the logic of the controller, such as by being hard-wired logic formed in the hardware of the controller.

The automatic control module 330 includes several modules that perform various operations described herein. The modules are shown as being included in the automatic control module 330. As described above, the modules may include hardware and/or software systems that operate to perform one or more functions, such as the controller and one or more sets of instructions. Alternatively, one or more of the modules may include a controller that is separate from the controller.

The location module 332 includes the manual location module 334 and the automatic location module 336. The location module 332 is configured to determine a position for the vehicle system 300, with the position used by the automatic control module 330 to determine appropriate automatic control activities, such as braking or slowing the vehicle in the event of upcoming misaligned switches and/or occupied sections of track. The location module 332 may determine an initial position of the vehicle system 300 (e.g., identification of a particular track upon which the vehicle system 300 disposed among a plurality of generally parallel tracks, and location and/or direction of the vehicle system 300 along the particular track), allowing the automatic control module 330 to be enabled or engaged. The location module 332 may also determine current or updated positions of the vehicle system 300 as the vehicle system travels along a given track and/or switches or changes the particular track or route being traversed.

The manual location module 334 is configured to obtain the manually input location information from the manual input module 310. The manually input information includes information specifying or otherwise corresponding to a particular route on which the vehicle system 300 is disposed. The particular route may be one of a plurality of generally parallel routes located proximately to each other in a territory. The location module 332 is configured to use the manually input location information to determine a position (e.g., an initial position) of the vehicle system 300. The initial position may be used to enable and initiate an automatic control system, such as an incremental control system that uses information obtained during performance of a mission or trip to update the position of the vehicle system 300 as the vehicle system 300 traverses a transportation network.

The automatic location module 336 is configured to obtain the automatic input location from the automatic input module 320. The automatic input information may include information corresponding to a location of the vehicle system 300 along a particular route. In some embodiments, the automatic input information may provide geographic coordinates describing the position of the vehicle system 300. Alternatively or additionally, the automatic information may include information corresponding to a particular segment of a route being traversed (e.g., a mile post or other indicator) or beginning or end points of a route being traversed, so that the location module 332 may identify a segment of track occupied by the vehicle system 300 and/or one or more upcoming segments of track that the vehicle system 300 is approaching.

The memory 338 may include a database 339. The database 339 may be configured to be used in conjunction with the location module 332 to help identify particular locations based on manually input information. For example, a given position identification sign may include a number or code that identifies that particular sign's location along the route, with the position stored in the database at a corresponding entry to all or a portion of the code. The code may also correspond to a signal or other feature of a track or route that is identified in a corresponding entry in the database 339. After the operator enters the code, the location module 332 may determine the position of the vehicle system 300 using the database 339, by identifying information corresponding to the particular code entered by the operator. A given code may identify a track feature and/or known location (e.g., a corresponding signal having a known location entered in the database 339), a particular track identifier (e.g., a number or letter assigned to a sign at a predetermined orientation relative to a particular track, for example, immediately to the right in the direction of travel), and/or a direction (e.g., a particular code may be assigned to a sign that is readable only when the vehicle system 300 is oriented in a given direction).

The trip planning control module 340 of the vehicle system 300 may be configured to receive a schedule sent by an off-board scheduling system. The trip planning control module 340 may include a controller, such as a computer processor or other logic-based device that performs operations based on one or more sets of instructions (e.g., software). The instructions on which the controller operates may be stored on a tangible and non-transitory (e.g., not a transient signal) computer readable storage medium, such as a memory 344. The memory 344 may include one or more computer hard drives, flash drives, RAM, ROM, EEPROM, and the like. Alternatively, one or more of the sets of instructions that direct operations of the controller may be hard-wired into the logic of the controller, such as by being hard-wired logic formed in the hardware of the controller.

The trip planning control module 340 may include one or more modules that perform various operations. The control module 342, along with other modules (not shown) may be included in the controller. As described above, the modules may include hardware and/or software systems that operate to perform one or more functions, such as the controller and one or more sets of instructions. Alternatively, one or more of the modules may include a controller that is separate from the controller, or may be combined to form a combined module.

The trip planning control module 340 may receive a schedule from a scheduling system. The trip planning control module 340 may be operatively coupled with, for example, the antenna 350 to receive an initial and/or modified schedule from the scheduling system. In one embodiment, the schedules are conveyed to the control module 342 of the trip planning control module 340. In another embodiment, the control module 342 may be disposed off-board the vehicle system 300 for which the trip plan is formed. For example, the control module 342 may be disposed in a central dispatch or other office that generates the trip plans for one or more vehicles.

In the illustrated embodiment, the control module 342 receives the schedule sent from the scheduling system and generates a trip plan based on the schedule. The trip plan may include throttle settings, brake settings, designated speeds, or the like, of the vehicle system 300 for various sections of a scheduled trip or mission of the vehicle system 300 to the scheduled destination location. The trip plan may be generated to reduce the amount of fuel that is consumed by the vehicle system 300 as the vehicle system 300 travels to the destination location relative to travel by the vehicle system 300 to the destination location when not abiding by the trip plan.

In order to generate the trip plan for the vehicle system 300, the control module 342 can refer to a trip profile that includes information related to the vehicle system 300, information related to a route over which the vehicle system 300 travels to arrive at the scheduled destination, and/or other information related to travel of the vehicle system 300 to the scheduled destination location at the scheduled arrival time. The information related to the vehicle system 300 may include information regarding the fuel efficiency of the vehicle system 300 (e.g., how much fuel is consumed by the vehicle system 300 to traverse different sections of a route), the tractive power (e.g., horsepower) of the vehicle system 300, the weight or mass of the vehicle system 300 and/or cargo, the length and/or other size of the vehicle system 300, the location of powered units in the vehicle system 300, or other information. The information related to the route to be traversed by the vehicle system 300 can include the shape (e.g., curvature), incline, decline, and the like, of various sections of the route, the existence and/or location of known slow orders or damaged sections of the route, and the like. Other information can include information that impacts the fuel efficiency of the vehicle system 300, such as atmospheric pressure, temperature, and the like.

The trip plan is formulated by the control module 342 based on the trip profile. For example, if the trip profile requires the vehicle system 300 to traverse a steep incline and the trip profile indicates that the vehicle system 300 is carrying significantly heavy cargo, then the control module 342 may form a trip plan that includes or dictates increased tractive efforts for that segment of the trip to be provided by the propulsion subsystem 360 of the vehicle system 300. Conversely, if the vehicle system 300 is carrying a smaller cargo load and/or is to travel down a decline in the route based on the trip profile, then the control module 342 may form a trip plan that includes or dictates decreased tractive efforts by the propulsion subsystem 350 for that segment of the trip. In one embodiment, the control module 342 includes a software application or system such as the Trip Optimizer™ system provided by General Electric Company. The control module 342 may directly control the propulsion system 360 and/or may provide prompts to an operator for control of the propulsion system 360. As discussed above, control activities planned by the trip planning control module 340 may be overridden by control activities called for by the automatic control module 330.

Figure 4:
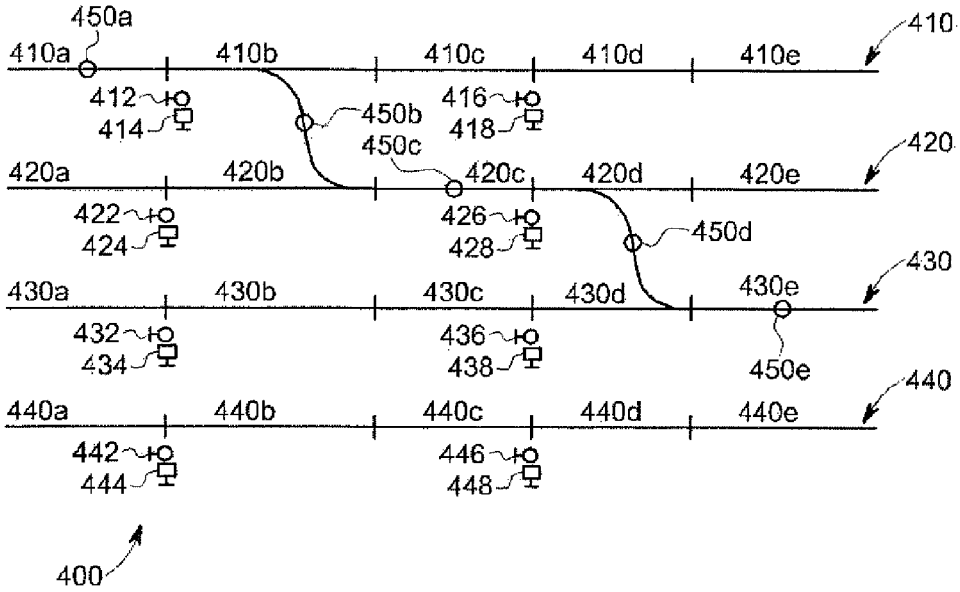
FIG. 4 is an overhead schematic view of a transportation network in accordance with one embodiment.

FIG. 4 provides an overhead schematic view of a transportation network 400. In the depicted embodiment, for the sake of clarity and simplicity, the transportation network 400 is depicted as including tracks extending generally straight from left to right (in the sense of FIG. 4) with segments being generally uniform in length and extending between generally equally spaced signals and switches. The depiction of FIG. 4 is intended to be illustrative in nature, and other arrangements may be employed in various embodiments. In practice, the tracks and/or segments may be of non-uniform lengths and may traverse curved profiles. Further, the switches and/or signal may be disposed non-uniformly along the length of the tracks of the transportation network, and may be disposed at different points along the lengths of different tracks.

In the illustrated embodiment, the transportation network 400 includes four generally parallel tracks 410, 420, 430, and 440. Each track 410, 420, 430, and 440 is further broken into five segments (e.g., 410*a*, 410*b*, 410*c*, 410*d*, 410*e*; 420*a*, 420*b*, 420*c*, 420*d*, 420*e*; 430*a*, 430*b*, 430*c*, 430*d*, 430*e*; 440*a*, 440*b*, 440*c*, 440*d*, 440*e*). Signs 414, 424, 434, 444 and corresponding signals (412, 422, 432, 442, respectively) are located at the junction between the a and b segments of each track 410, 420, 430, 440, respectively. The signs may be configured as discussed elsewhere herein to provide information to an operator for manually inputting to an on-board computer. For example, each sign may contain an identifier corresponding to direction of orientation, location along track (e.g., along a one-dimensional representation of the particular track), and particular track identification information. In the illustrated embodiment, the signs are positioned to the immediate right of a corresponding route segment proximate to a signal. Similarly, signs 418, 428, 438, 448 and corresponding signals (416, 426, 436, 446, respectively) are located at the junction between the c and d segments of each track 410, 420, 430, 440.

The transportation system also includes a vehicle system 450, which is depicted at various points along a route traversed during a mission depicted as 450*a*, 450*b*, 450*c*, 450*d*, and 450*e* in FIG. 4. At 450*a*, the vehicle system is stopped at signal 412. The operator of the vehicle system may view the sign 414 and enter information from the sign to an on-board computer of the vehicle system using a user interface. The on-board computer may then use the information entered to determine the particular track on which the vehicle system is disposed, the direction the vehicle system is headed, and the location along the particular route. The location along the route may be represented as a point along the route and/or a length along the route corresponding to the length of the vehicle system plus a forward buffer and a rearward buffer.

In the illustrated embodiment, with the vehicle system at 450*a*, if the information from the sign 414 is correctly entered, the on-board computer system may determine that the vehicle system is at a determined position within route segment 410*a* proximate to the signal 412, and oriented to travel in the left-to-right direction (in the sense of FIG. 4). With a switch associated with signal 412 properly aligned and the next segment along the vehicle system's path clear of other vehicle systems, the signal may change to allow the vehicle system to progress. In the illustrated embodiment, the vehicle system progresses over a switch to route segment 420*b* of track 420. As the vehicle system traverses the switch through point 450*b*, the vehicle system receives a signal or message (e.g., from a signal, switch, and/or wayside station) that the vehicle system is being changed to track 420. As the vehicle system progress to point 450*c*, the on-board computer may receive updated location information from, for example a GPS detector, and update the determined position to reflect that the vehicle system is disposed on segment 420*c* of track 420. The on-board computer uses the message or signal to update the determined position of the vehicle system to include track 420 as the particular track upon which the vehicle system is disposed.

As the vehicle system progresses, the vehicle system may receive a message or signal that a switch at the junction of 420*c* and 420*d* is aligned to transfer the vehicle system to track 430. If the switch is properly aligned and the signal indicates the vehicle system is clear to traverse the switch, the vehicle system may then proceed to point 450*d*, with the on-board computer receiving a message or signal regarding the change and updating the particular track identification to 430. In the illustrated embodiment, the vehicle system than traverses the route to point 450*e*, where the on-board computer uses GPS information to update the position to reflect that the vehicle is on route segment 430*e* of track 430, and oriented in the left-to-right direction of travel. As the vehicle progresses, an automatic control system may utilize the position determined by the on-board computer to stop the vehicle system to avoid, for example, an occupied segment of track.

Figure 5:
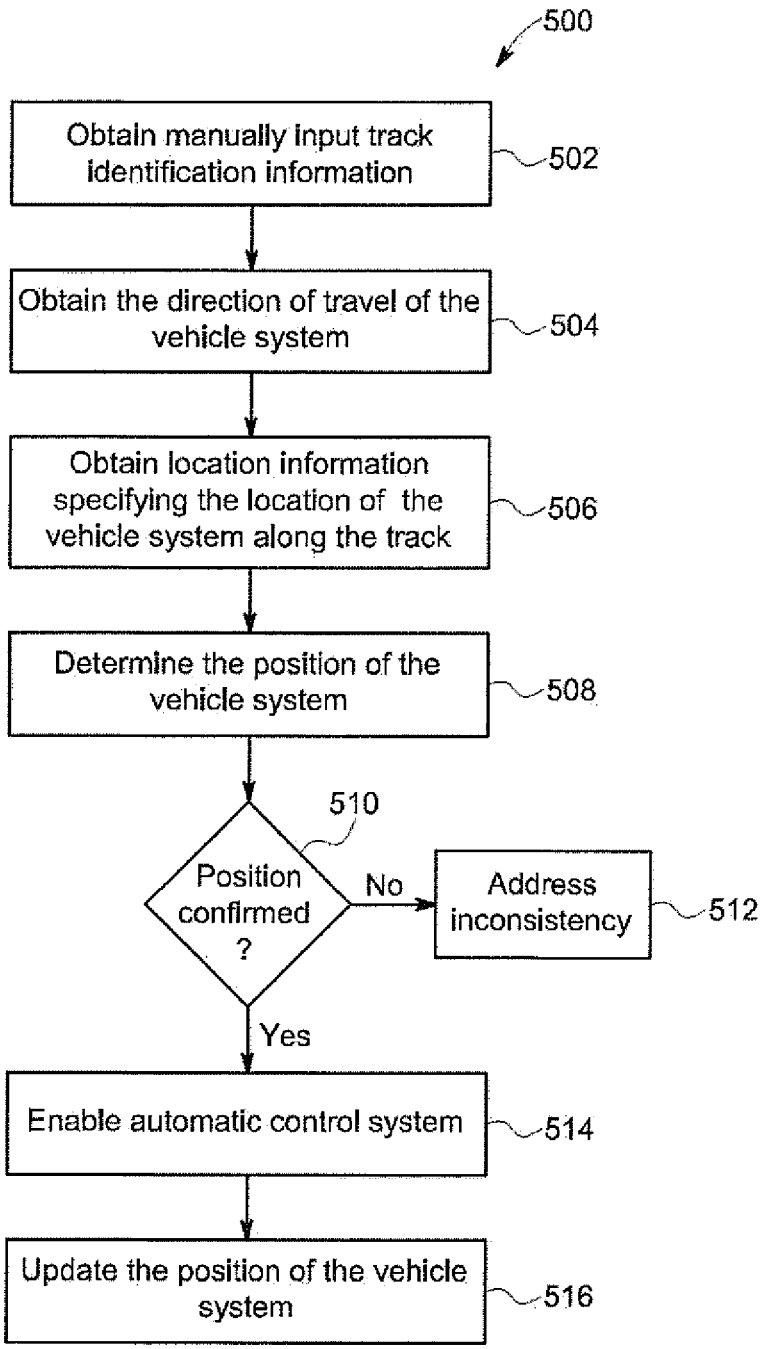
FIG. 5 is a flowchart of one embodiment of a method determining the position of a vehicle system in accordance with one embodiment.

FIG. 5 is a flowchart of one embodiment of a method 500 for determining the position of a vehicle system, including identification of a particular track or route on which the vehicle is disposed out of a plurality of generally parallel tracks or routes. The method 500 may be performed, for example, using certain components, equipment, structures, or other aspects of embodiments discussed above. In certain embodiments, certain steps may be added or omitted, certain steps may be performed simultaneously or concurrently with other steps, certain steps may be performed in different order, and certain steps may be performed more than once, for example, in an iterative fashion.

At 502, with the vehicle system at a stop, manually input track identification information is obtained. The track identification may be manually input and provided to an on-board computer for use in determining a position (e.g., an initial or reference position) of the train to be used in employing an automatic control system. The track identification information corresponds to a particular track or route on which the vehicle system is disposed. The particular track or route may be one of a plurality of proximately located tracks or routes (e.g., one of two or more generally parallel tracks configured for rail vehicles). For example, a sign may be disposed along or near a track being traveled by the vehicle system in a location easily viewable by an operator (e.g., along the right side of the track in the direction of travel). The sign may be positioned proximate to a signal at which the vehicle system is stopped, and display an alpha-numeric or other code identifying the position and/or orientation of the sign. The track identification information may be entered by an operator using a touch screen or keypad, and input into an on-board computer. In some embodiments, the on-board computer may prompt the operator to enter location information via a user interface. For example, the on-board computer may be configured to prompt the operator to enter track identification information at any stop at which the on-board computer is unable to determine the particular track on which the vehicle is disposed. In some embodiments, the operator may be prompted to identify the track using a visually ascertainable feature or characteristic of the track. For example, the operator may enter information corresponding to the position of the track relative to other proximately located tracks (e.g., identifying the track as the right-most track or left-most track in the direction of travel; identifying the track as the center track of three; identifying the track as being positioned second to the right of five tracks; or the like).

At 504, the direction of travel of the vehicle system is obtained. The direction of travel information may be manually input and provided to an on-board computer for use in determining a position of the train to be used in employing an automatic control system. The direction of travel may be obtained by manual input. In some embodiments, the direction of travel is provided via the alphanumeric or other code displayed on a sign, such as a sign as discussed above. In some embodiments, a particular sign may be viewable only from a given direction, so that the direction of travel may be determined by entry of a code identifying the particular sign. In other embodiments, an operator may be prompted to enter a direction separately from an entry of information from a sign.

At 506, location information specifying the location of the vehicle system along the particular route or track is obtained. The location information may be obtained via manual input and/or automatically. For example, the location information may be determined using an alphanumeric or other identification of a sign observed by an operator of the vehicle system and input to an on-board computer. In some embodiments, the particular code or portion of a code entered from a sign may have a location associated therewith in a database entry. The on-board computer accesses the database, and determines the location using the corresponding entry in the database corresponding to the identification information for the sign. In some embodiments, the sign may have a corresponding signal, with the location of the signal also stored in an entry in the database corresponding to the location. In some embodiments, the location information may be obtained automatically, for example via a GPS detector. In some embodiments, the location may be represented via geographic coordinates (e.g., a given position north/south in degrees, minutes, and seconds and a given position east/west in degrees, minutes, and seconds), while in other embodiments the location may be represented as a point along the particular track on which the vehicle is disposed (e.g., a milepost or other marker or indicator), with the track represented as a one-dimensional track and the location as a point along the length of the one-dimensional representation of the track. The location information may be used to determine a particular segment or length of the track on which the vehicle system is disposed.

At 508, the position of the vehicle system is determined. In some embodiments, the position determination may include identifying a particular track upon which the vehicle is disposed, a direction of orientation of the vehicle, and a location along the particular track. The identification of the particular track (e.g., a track from among a plurality of generally parallel tracks in a given territory or area) may be determined using manually input information (e.g., an indication of the position of the particular track relative to other proximate tracks, or an identification code obtained from a sign disposed in a predetermined position proximate the track, for example immediately to the right of the track in the direction of travel). The direction of travel may also be determined via manually input information. For example, each sign may only be visible in a particular orientation, so that the identification of the sign also identifies the direction of travel. As another example, a sign may contain a code that identifies the direction, with the code used by an on-board computer accessing a database to determine the direction. In some embodiments, an operator may be prompted to confirm that the direction the operator is viewing the sign is the direction of travel. For example, for an operator oriented toward the dead end of a dead end siding, the direction of travel may be the opposite of the direction in which the operator is viewing a sign. In such instances, the operator may input an indication that the direction of travel is opposite the viewing direction of the sign containing the information being input. The location along the length of the track may be determined using identification information from a sign (e.g., a code with a location identified in a database accessible by the on-board computer receiving the code as a manual input from an operator) and/or automatically (e.g., from a GPS or other automatic location detector).

The on-board computer may, for example, make an adjustment to the location information provided by the automatic detector and/or manual input. For example, the on-board computer may make an adjustment for a GPS detector based on the difference between the location of the GPS detector and the front and/or rear of the consist. As another example, the location of a sign may be adjusted to compensate for the difference between the position of the sign and the front and/or rear of the vehicle system. In embodiments, the operator enters the coded information from the sign at a predetermined distance from the sign. The on-board computer may then determine the operator's location by adjusting the sign's location by the predetermined offset. Then, by using the distance from the operator to the front and/or rear of the vehicle system, the position of the front and/or rear of the vehicle system may be determined. In some embodiments, the position of the vehicle system may be represented as an envelope or other length along a particular track defined by the position of the front and/or rear of the consist, plus the length of the consist, plus one or more buffers (e.g., WCA and WCB).

At 510, a position determined by the on-board computer is confirmed. In some embodiments, the operator may be requested to confirm an entry before the information is entered. As another example, after the operator enters certain information, the operator may be prompted to enter additional information or respond to questions designed to confirm the original entry. For instance, after entering an alphanumeric code identifying a particular track on which the vehicle is disposed, the operator may be asked the relative position of the particular track compared to other tracks in the location, and the response compared to the coded entry for accuracy. Additionally or alternatively, manually input information may be checked against automatically input information to confirm that the manually input information and automatically input information do not substantially differ. If the manually input information and the automatically input information differ by more than a predetermined threshold, the position may not be confirmed. For example, a location along a particular track may be determined by accessing a location corresponding to a manually input sign code, and the location compared to the location as determined via a GPS detector. If the two locations substantially differ, the manual entry and/or the determined position may not be confirmed. In some embodiments, if the manually entered information is not consistent with known information regarding a particular location, then the entry may not be confirmed. For example, if the operator enters a direction (e.g., north) in a region where the track is running a substantially different direction (e.g., east/west), the entry may not be confirmed. As another example, if the operator enters track identification information that is inconsistent with known features of a given location (e.g., an entry of "right-most of three tracks" is entered in an area known to have four tracks), the entry may not be confirmed. By confirming the entry, errors due improper operator entry may be checked before proceeding using an incorrect identification. The determined position may be locked in for use (or "frozen") upon confirmation, and unfrozen once brake released and/or vehicle starts in motion to allow for updating once the vehicle system is in motion. In some embodiments, if the determined position is confirmed, the method proceeds to 514, but if the determined position is not confirmed, the method proceeds to 512.

At 512, the inconsistency between the manually input information and the automatically input information, or other cause for failure to successfully confirm, is addressed. In some embodiments, a user interface used by the operator alerts the operator of the inability to successfully confirm the determined position, and prompts the operator to re-enter all or a portion of the information. If the on-board computer is able to successfully confirm a determined position based on the re-entry of manually input information, then the position may be confirmed and the automatic control system engaged or enabled. If the on-board computer is unable to successfully confirm the position of the vehicle system, then the automatic control system may be disengaged until the on-board computer is able to successfully confirm the determined position or location. In some embodiments, a user interface may be configured to alert and/or prompt the operator to enter manually input information at the next available stop along the mission being performed by the vehicle, for example a stop at a subsequent signal.

At 514, with the determined position or location successfully confirmed, a control system, for example an ITCS operated in conjunction with an automatic control module of an on-board computer such as automatic control module 330, is enabled. The control system may be configured to over-ride a control system or an operator input, and to stop or slow the vehicle system using the position of the vehicle system, for example, to prevent the risk of collision from the vehicle system entering an occupied segment of track, or to prevent damage to a mis-aligned switch in the upcoming path of the vehicle system.

At 516, the position of the vehicle system is updated as the vehicle system traverses a route. The position of the vehicle may be updated substantially continuously, or at predetermined intervals. The location of the vehicle along a route as well as the identification of the particular route upon which the vehicle system is disposed may be updated. For example, the on-board computer may update the location along the route using information from a GPS detector. As another example, the location of the vehicle system may be updated as the vehicle system passes a wayside station, with the vehicle system receiving a signal identifying the wayside station and determining the location using a database identifying the position of the wayside station correlated with identifying information of the wayside station. The particular route being traversed may be updated, for example, by the vehicle system receiving a message or signal from a switch (or associated signal and/or wayside station) indicating that the vehicle system is changing tracks at the switch. Confirmation of the manually input information may also be performed in an ongoing manner. For example, if the direction of the vehicle system as determined by the change in a series of GPS readings contradicts the direction determined using manually input information, then the direction may be changed, or, in some embodiments, the automatic control system may be disengaged until the direction can be confirmed. As another example, the position as determined by the on-board computer may be compared with an occupancy determined by a track circuit. If the determined position does not match the track circuit occupancy, the automatic control system may be disengaged until the location can be confirmed.

A few exemplary scenarios of the entry of information and engagement of an automatic control system will now be discussed. In one exemplary scenario, the train operator correctly enters the signal name from the signboard. The on-board computer uses the manually entered information to determine the track number and direction of the vehicle system. The on-board computer then freezes the WCA and WCB and cuts in (e.g., engages) while monitoring validity of the location using automatically obtained location information, and also monitoring status of a brake (e.g., an independent brake) and monitoring the stationary condition of the vehicle. When the independent brake is released and/or the vehicle starts moving, the WCA and WCB are un-frozen, and the WCA and WCB may be updated as the vehicle progresses along a route. When the vehicle passes a signal, the on-board computer may adopt the signal as a location along the route, and if the vehicle passes over a switch, the on-board computer may use the switch status to determine the new track number (or other identifier).

In another exemplary scenario, the operator enters an incorrect entry. If the operator realizes the incorrect entry before confirming the entry (e.g., a prompt from a user interface may request the operator to confirm the entry before the on-board computer downloads the manually input information), the operator may re-start the data entry process from the beginning. If the operator realizes the mistake after confirming an incorrect entry (either on the operator's own initiative or after a prompt from the on-board computer indicating an incorrect entry), the on-board computer may set the track number and train direction to unknown, and not allow the automatic control system to cut in until a track number and train direction have been confirmed.

In yet another exemplary scenario, the train operator enters the data entry with the vehicle system oriented opposite to the eventual direction of travel (e.g., the data is entered in a short hood forward orientation but the vehicle will travel in a long hood forward orientation). The operator may provide an indication of the change in orientation, and the on-board computer may use the provided information to set the direction to the direction opposite of the direction indicated in the sign identification, and the automatic control system may cut in (e.g., engage).

In still another exemplary scenario, the independent brake is released while the manually input information is being entered. Thus, the on-board computer may have identified the track identification and direction, but may not have been able to determine and/or freeze the WCA, WCB, and/or other parameter used by the automatic control system. The vehicle may then progress to the next signal before the automatic control system cuts in. For example, the operator may set the brake and achieve a stationary status at the next signal, and enter information from a location identification sign positioned proximate that particular signal to re-start the manual entry process and determination of the vehicle's location.

In another exemplary scenario, the entry of manually input information may be aborted due to the movement of the train during the entry. The track number and direction may be set to unknown, and the automatic control system not engaged. At the next opportunity (e.g., the vehicle stationary proximate to a location identification sign), the manually input information may be entered and used by the on-board computer to determine the position of the vehicle, thereby allowing the automatic control system to engage.

Thus, embodiments provide for the use of manually input information to determine a starting position and automatically input information to confirm the manually input information and/or to update the location of the vehicle during performance of a mission. Embodiments provide for the manually input information to specify which route the vehicle is disposed on out of a plurality of generally parallel routes. Embodiments also provide for cost-effective and low-maintenance identification of position of a vehicle.

In one embodiment, a system includes an automatic control module, an automatic location module, and a manual location module. The automatic control module is configured to be disposed onboard a vehicle, and to control the vehicle to conform to a set of regulations along route during a mission using location information. The set of regulations may include location based regulations, and the location information may include first location information and second location information. The automatic location module may be configured to automatically obtain, without operator intervention, the first location information. The manual location module may be configured to obtain the second location information via an operator input. The manually entered location information may include information corresponding to a first route on which the vehicle is disposed, where the first route is one of a plurality of routes located proximately to each other in a territory. Each of the plurality of routes may be configured for traversal by the vehicle.

In another aspect, the second location information may be obtained from an operator viewing a sign disposed proximate to the first route on which the vehicle is disposed and inputting the second location information based on the sign. For example, the second location information may include location information corresponding to a location of the sign, direction information corresponding to a direction in which the vehicle is oriented, and route information corresponding to the first route on which the vehicle is disposed. As another example, the sign may be positioned proximate to a signal configured to provide a movement regulation the vehicle, and the sign and the signal may share a common identifier in a database disposed onboard the vehicle and configured to be accessed by the automatic control module.

In another aspect, the plurality of routes may define a generally longitudinal direction of travel, and the second location information may include information describing a generally lateral position of the first route relative to at least one other route of the plurality of routes.

In another aspect, at least a portion of the first location information may be used to at least one of confirm or check at least a portion of the second location information.

In another aspect, the automatic control module is configured to not use the second location information if at least a portion of the second location information is substantially different from a corresponding portion of the first location information.

In another aspect, the automatic control module may be configured to use the second location information to determine an initial position and to use the first location information to control performance of the mission.

Another embodiment relates to a method that includes obtaining, at a processing unit (e.g., a processing unit disposed onboard a vehicle), manually entered location information including information corresponding to a first route on which the vehicle is disposed. The first route is one of a plurality of routes located proximately to each other in a territory, with each of the plurality of routes configured for traversal by the vehicle. The method also includes obtaining, at the processing unit, automatically obtained location information from an automatic location detection module. The method also includes determining a determined position of the vehicle using the manually entered location information and the automatically obtained location information. The determined position of the vehicle includes an identification of a particular route on which the vehicle is disposed and information corresponding to a location along the particular route. The method further includes controlling the vehicle using an automatic control system based upon the determined position of the vehicle, wherein controlling the vehicle comprises conforming with a set of location-based regulations using the determined position of the vehicle.

In another embodiment of the method, the manually entered location information is provided by an operator viewing a sign disposed proximate to the first route on which the vehicle is disposed and inputting the manually entered location information based on the sign. In some embodiments, the manually entered location information includes location information corresponding to a location of the sign, direction information corresponding to a direction in which the vehicle is oriented, and route information corresponding to the first route on which the vehicle is disposed. In some embodiments, the sign is positioned proximate to a signal configured to provide a movement regulation to the vehicle. The sign and the signal may share a common identifier in a database disposed onboard the vehicle and configured to be accessed by the processing unit. Determining the determined position may include accessing the database, determining the location of the signal, and using the location of the signal to determine the determined position.

In another embodiment of the method, the method also includes confirming at least a portion of the manually entered information using the automatically entered information. In some embodiments, the method includes successfully confirming the at least a portion of the manually entered information before controlling the vehicle using the automatic control system.

In another embodiment of the method, the method further includes obtaining updated automatically obtained location information as the vehicle performs a mission. The method also includes determining an updated determined position using the updated automatically obtained location information, and controlling the vehicle using the automatic control system based upon the updated determined position of the vehicle.

In one embodiment, a tangible and non-transitory computer readable medium includes one or more computer software modules configured to obtain manually entered location information including information corresponding to a first route on which a vehicle is disposed, wherein the first route is one of a plurality of routes located proximately to each other in a territory, wherein each of the plurality of routes is configured for traversal by the vehicle. The computer readable medium is further configured to direct the processor to obtain automatically obtained location information from an automatic location detection module. The computer readable medium is further configured to direct the processor to control the vehicle, using an automatic control system, based upon the determined position of the vehicle to conform with a set of location-based regulations using the determined position of the vehicle.

In another aspect, the manually entered location information may be provided by an operator viewing a sign disposed proximate to the first route on which the vehicle is disposed and inputting the manually entered location information based on the sign. In some embodiments, the manually entered location information may include location information corresponding to a location of the sign, direction information corresponding to a direction in which the vehicle is oriented, and route information corresponding to the first route on which the vehicle is disposed. In some embodiments, the sign is positioned proximate to a signal configured to provide a movement regulation to the vehicle. The sign and the signal may share a common identifier in a database disposed onboard the vehicle and configured to be accessed by the processor. The computer readable medium may be further configured to direct the processor to determine the location of the signal using the database, and to use the location of the signal to determine the determined position.

In another aspect, the computer readable medium may be further configured to direct the processor to confirm at least a portion of the manually entered information using the automatically entered information. In some embodiments, the computer readable medium may be further configured to direct the processor to successfully confirm the at least a portion of the manually entered information before the automatic control system is engaged.

In another aspect, the computer readable medium may be further configured to direct the processor to obtain updated automatically obtained location information as the vehicle performs a mission, determine an updated determined position using the updated automatically obtained location information, and control the vehicle using the automatic control system based upon the updated determined position of the vehicle.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose several embodiments of the inventive subject matter, and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, controllers or memories) may be implemented in a single piece of hardware (for example, a general purpose signal processor, microcontroller, random access memory, hard disk, and the like). Similarly, the programs may be stand-alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the presently described inventive subject matter are not intended to be interpreted as excluding the existence of additional embodiments that also incorporate the recited features. Moreover, unless explicitly stated to the contrary, embodiments "comprising," "comprises," "including," "includes," "having," or "has" an element or a plurality of elements having a particular property may include additional such elements not having that property.

What is claimed is:

1. A system comprising:

a sign having an alphanumeric code, the sign disposed along a first route of a plurality of routes traveled by a vehicle, the plurality of routes located proximately to each other in a territory, wherein each of the plurality of routes is configured for traversal by the vehicle, the alphanumeric code comprising a first portion corresponding to an identification of the first route on which the vehicle is disposed, a second portion corresponding to a position along the first route at which the vehicle is located, and a third portion corresponding to a direction of travel of the vehicle; and at least one processor configured to be disposed onboard the vehicle, the at least one processor configured to:

automatically obtain, without operator intervention, first location information corresponding to a location of the vehicle;

obtain second location information manually entered via an operator input, the second location information obtained independently of the first location information, the second location information including information corresponding to the first route on which the vehicle is disposed, the second location information corresponding to the alphanumeric code of the sign;

determine a second location information-based position of the vehicle using the second location information and the first location information, the second location information-based position of the vehicle specifying the identity of the first route upon which the vehicle is disposed, the position of the vehicle along the first route, and the direction of the vehicle based on the second location information, wherein at least a portion of the second location information-based position of the vehicle is determined using the second location information independently of the first location information; and control the vehicle to conform to a set of location-based regulations during a trip based on the determined second location information-based position.

2. The system of claim 1, wherein the sign is positioned proximate to a signal configured to provide a movement regulation to the vehicle, and wherein the sign and the signal share a common identifier in a database disposed onboard the vehicle and configured to be accessed by the at least one processor.

3. The system of claim 1, wherein the plurality of routes define a generally longitudinal direction of travel, and where the second location information includes information describing a generally lateral position of the first route relative to at least one other route of the plurality of routes, and wherein the at least a portion of the second location information-based position determined using the second location information independently includes an identification of the first route.

4. The system of claim 1, wherein the at least one processor is configured to initially determine a manual information-based position using only the second location information, and to use at least a portion of the first location information to at least one of confirm or check at least a portion of the determined manual information-based position.

5. The system of claim 1, wherein the at least one processor is configured not to use the second location information if at least a portion of the second location information is substantially different from a corresponding portion of the first location information.

6. The system of claim 1, wherein the at least one processor is configured to use the second location information to determine an initial position and to use the first location information to control performance of the trip.

7. The system of claim 1, wherein the system is configured to provide a prompt to an operator to provide the second location information responsive to a stop performed by the vehicle subsequent to commencement of the trip.

8. A method comprising:

with a vehicle, passing by a sign disposed along a first route traversed by the vehicle, the sign comprising an alphanumeric code, wherein the first route is one of a plurality of routes located proximately to each other in a territory, wherein each of the plurality of routes is configured for traversal by the vehicle, the alphanumeric code comprising a first portion corresponding to an identification of the first route on which the vehicle is disposed, a second portion corresponding to a position along the first route at which the vehicle is located, and a third portion corresponding to a direction of travel of the vehicle;

obtaining, at a processing unit disposed onboard the vehicle, manually entered location information including information corresponding to the first route on which the vehicle is disposed, wherein the manually entered location information corresponds to the alphanumeric code of the sign;

obtaining, at the processing unit, automatically obtained location information from an automatic location detection module;

determining a determined position of the vehicle using the manually entered location information and the automatically obtained location information, wherein at least a portion of the determined position is determined using the manually entered location information independently of the automatically obtained location information, the determined position of the vehicle including an identification of a particular route on which the vehicle is disposed and information corresponding to a location along the particular route; and controlling the vehicle, using an automatic control system, based upon the determined position of the vehicle, wherein controlling the vehicle comprises conforming with a set of location-based regulations using the determined position of the vehicle.

9. The method of claim 8, further comprising confirming at least a portion of the manually entered information using the automatically determined information.

10. The method of claim 9, further comprising successfully confirming the at least a portion of the manually entered information before controlling the vehicle using the automatic control system.

11. The method of claim 8, further comprising:

obtaining updated automatically obtained location information as the vehicle performs a trip;

determining an updated determined position using the updated automatically obtained location information; and controlling the vehicle using the automatic control system based upon the updated determined position of the vehicle.

12. The method of claim 8, further comprising providing a prompt, responsive to a stop performed by the vehicle subsequent to commencement of the trip, to an operator to obtain the manually entered location information.

* * * * *